United States Patent [19]

Spaziante et al.

[11] 4,119,503

[45] Oct. 10, 1978

[54] TWO LAYER CERAMIC MEMBRANES AND THEIR USES

[75] Inventors: Placido Maria Spaziante; Antonio Nidola, both of Lugano, Switzerland

[73] Assignee: Oronzio de Nora Impianti Elettrochimici S.p.A., Milan, Italy

[21] Appl. No.: 855,176

[22] Filed: Nov. 28, 1977

[30] Foreign Application Priority Data

Jul. 15, 1977 [IT] Italy ..... 25779 A/77

[51] Int. Cl.[2] ..... C25B 9/00; C25B 1/00; C25B 3/00; C25B 13/04

[52] U.S. Cl. ..... 204/59 R; 204/82; 204/94; 204/95; 204/98; 204/128; 204/263; 204/282; 204/295; 204/72; 204/180 P

[58] Field of Search ..... 204/98, 195 S, 252, 204/263, 282, 283, 295, 72, 94, 128, 59; 429/193

[56] References Cited

U.S. PATENT DOCUMENTS

| | | | |
|---|---|---|---|
| 984,915 | 2/1911 | Heltzen | 204/295 X |
| 1,082,286 | 12/1913 | Ruhm | 204/266 |
| 3,392,103 | 7/1968 | Berger | 204/295 |
| 3,437,580 | 4/1969 | Arrance et al. | 204/295 |
| 3,479,266 | 11/1969 | Rajan et al. | 204/180 P |
| 3,497,389 | 2/1970 | Berger et al. | 429/33 |
| 3,822,198 | 7/1974 | Bauke | 204/195 M |

*Primary Examiner*—F.C. Edmundson
*Attorney, Agent, or Firm*—Hammond & Littell

[57] ABSTRACT

Novel two layer ceramic membranes for electrolysis cells comprising on the anodic side a layer of at least one oxide selected from the group consisting of $Sb_2O_5$, $Bi_2O_5$, $MoO_3$, $WO_3$ and $V_2O_5$ and on the cathodic side a layer of at least one oxide selected from the group consisting of $ZrO_2$, $Nb_2O_5$, $Ta_2O_5$ and $TiO_2$, electrodes provided with a two layer ceramic membrane applied thereto, an electrolysis cell provided with a two layer ceramic oxide membrane and an electrolysis process wherein a two layer ceramic membrane is in the electrodic gap.

28 Claims, No Drawings

TWO LAYER CERAMIC MEMBRANES AND THEIR USES

STATE OF THE ART

During electrolysis reaction such as the electrolysis of brine to form chlorine at the anode and caustic soda at the cathode, the anolyte and catholyte are usually separated by a diaphragm or a membrane. Asbestos has been usually used commercially as the diaphragm and single metal oxide systems have been attempted to be used as a membrane material but these have been unsuccessful for a variety of reasons such as too high an isoelectric point and/or insufficient chemical stability, etc.

OBJECTS OF THE INVENTION

It is an object of the invention to provide a two layer ceramic oxide membrane for electrolysis cells.

It is a further object of the invention to provide novel electrode structures supporting a two layer ceramic oxide membrane and to an electrolysis cell equipped with said electrode structures.

It is an additional object of the invention to provide a novel electrolysis process wherein a two layer ceramic oxide membrane separates the anode and cathode.

These and other objects and advantages of the invention will become obvious from the following detailed description.

THE INVENTION

The novel two layer ceramic oxide membranes of the invention are comprised of on the anodic side a layer of at least a material selected from the group consisting of $Sb_2O_5$, $Bi_2O_5$, $MoO_3$, $WO_3$, $V_2O_5$ and mixtures thereof and on the cathodic side a layer of at least a material selected from the group consisting of $ZrO_2$, $Nb_2O_5$, $Ta_2O_5$, $TiO_2$ and mixtures thereof. The ceramic oxide membrane is preferably applied to an electrode structure to form a complete unit and the electrode is preferably the anode but may also be the cathode.

The electrode base material may be any electrically conductive material which is resistant to the electrolysis conditions for a cell such as graphite. When it is the cathode, it may be made steel, stainless steel, nickel or iron but is preferably iron or steel mesh. When it is an anode, it is preferably made of a valve metal such as titanium, zirconium, tantalum, niobium, hafnium, vanadium or alloys thereof and the active surface is provided with an electrocatalytic coating containing a platinum group metal oxide such as disclosed in U.S. Pat. Nos. 3,778,307 and 3,711,385. The preferred anode material is titanium with an electrocatalytic coating of a mixed crystal material of titanium dioxide and ruthenium oxide.

By mixed-crystal material is generally understood that the molecular lattices of the oxide of the film-forming metal are intertwined with the molecular lattices of the other material constituting the coating. There are various methods of achieving such a structure, some of which will be described hereinafter in connection with the processes for making the electrode according to the invention, but this is not intended to restrict the scope of the invention.

The other material of the mixture consists of one or more representatives of the non-film forming conductors. This other material may consist of a mixture of a metal and the oxide of the metal, or of a mixture of two metals or of a mixture of a metal and an oxide of a different metal, or other permutations and combinations of conductors and oxides. Preferably the conductors belong to the group consisting of gold, silver, platinum, palladium, iridium, ruthenium, osmium, rhodium, iron, nickel, chromium, copper, lead, manganese, and the oxides thereof, graphite, nitrides, carbides and sulfides.

The coating according to the invention need not cover the entire surface of the electrode to be immersed in the electrolyte. As a matter of fact, the coating need only cover 2% of the immersed zone, and the electrode will still operate effectively and efficiently.

While the membranes may be applied to the cathode or the anode, the anode is preferred as the ceramic oxide membrane has a higher degree of adherence to the valve metal than the steel cathode material. When deposited on the cathode, the membrane at its surface with the steel cathode may be contaminated and even plugged by formation of iron oxides if the cell is shut down and this does not occurr at the ceramic oxide interface with the valve metal substrate. The membrane on the cathode can be plugged inside with precipitated alkaline earth metal hydroxides which does not occur at the anode.

Generally speaking, the layer of the membrane on the anode side has both a very low isoelectric point i.e. a $pH \leqq 2.5$ which may act as the cation carrier and has a higher chemical stability in acid solutions. The layer of the membrane on the cathode side has a high chemical stability in strongly alkaline solutions and has a high isoelectric point, i.e. a $pH \geqq 5.0$.

The two layer ceramic oxide membranes may be applied to the cathode or anode by any convenient means such as by plasma jet or by sintering of the materials at a temperature below the melting point of the electrode. Preferably, the oxides are applied by plasma jet as powder with an appropriate mesh size such as 150 to 250 mesh. The application conditions are well known for this procedure and may be for example 4000° C. with a gas carrier under pressure and at a distance of 20 to 30 cm. The thickness of the membrane should be as thin as possible and is preferably about 50 to 500 $\mu$m.

Before the ceramic oxide membrane is applied the electrode base, is preferably cleaned and then roughened by sand blasting or acid etch to improve the adhesion. To avoid the ceramic oxide membrane from covering the active electrode surface which is on the back side or side opposite the membrane, the active surface is preferably protected before application of the membrane by a thin coat of a metal such as zinc, tin or aluminum or other metal which is easily removed later by melting or dissolution in a solvent such as 3 to 5% nitric acid or 3 to 5% sodium hydroxide or other appropriate means.

The novel process of the invention for the preparation of an electrode structure provided with a two layer ceramic oxide membrane comprises cleaning the electrode, applying to the active electrode surface a thin layer of an easily removable metal, applying the two layer oxide membrane to the electrode with the phase towards the anolyte being selected from the group consisting of $Sb_2O_5$, $Bi_2O_5$, $MoO_3$, $WO_3$ $V_2O_5$ and mixtures thereof, and the phase towards the catholyte being selected from the group consisting of $ZrO_2$, $Nb_2O_5$, $Ta_2O_5$, $TiO_2$ and mixtures thereof and removing the protective metal layer from the active electrode surface. Mixtures of substantially any proportion of 2 or more of the oxides in each phase or layer may be used.

The novel electrolysis cell of the invention is comprised of a cell having at least one electrode pair of an anode and cathode and provided with electrolyte inlet and outlet means, means for impressing a direct current on the cell, means for recovering the electrolysis products and a two layer ceramic oxide membrane on one of the electrodes with the layer towards the anolyte being selected from the group consisting of $Sb_2O_5$, $Bi_2O_5$, $MoO_3$, $WO_3$, $V_2O_5$ and mixtures thereof and the layer towards the catholyte being selected from the group consisting of $ZrO_2$, $Nb_2O_5$, $Ta_2O_5$, $TiO_2$ and mixtures thereof.

The novel electrolysis process of the invention comprises electrolyzing an electrolyte between an anode and a cathode with a direct current, the improvement comprises providing one of the said electrodes with a two layer ceramic oxide membrane with the phase towards the anolyte being selected from the group consisting of $Sb_2O_5$, $Bi_2O_5$, $MoO_3$, $WO_3$, $V_2O_5$ and mixtures thereof and the phase towards the catholyte being selected from the group consisting of $ZrO_2$, $Nb_2O_5$, $Ta_2O_5$, $TiO_2$ and mixtures thereof inside of the electrodic gap. The process is particularly useful for the production of halogens by electrolysis of aqueous alkali metal halides of chlorides, hypochlorites, persulfates, perborates, oxidation of organic compounds, etc. Particularly preferred is the production of chlorine by the electrolysis of brine.

Examples of preferred two layer ceramic oxide membranes are $ZrO_2$-$Sb_2O_5$, $Ta_2O_5$-$Sb_2O_5$, $Ta_2O_5$-$Bi_2O_5$, $Ta_2O_3$-$WO_3$, $Ta_2O_5$-$MoO_3$, $Ta_2O_5$-$V_2O_5$, $ZrO_2$-$Bi_2O_5$, $ZrO_2$-$WO_3$, $ZrO_2$-$MoO_3$, $ZrO_2$-$V_2O_5$, $TiO_2$-$Sb_2O_5$, $TiO_2$-$WO_3$, $TiO_2$-$V_2O_5$, $Nb_2O_5$-$Sb_2O_5$, $Nb_2O_5$-$WO_3$, $Nb_2O_5$-$V_2O_5$, $ZrO_2TaO_5$ - $SbO_5$, $ZrO_2Ta_2O_5$ - $Sb_2O_5$, $B_2O_5$ etc.

In the following examples there are described several preferred embodiments to illustrate the invention. However, it is to be understood that the invention is not intended to be limited to the specific examples.

EXAMPLE 1

An expanded iron cathode base which had been sandblasted was precoated on its back side with a thin layer (1 to 2 mm) of zinc by plasma jet to close the voids and avoid deposition of oxides thereon. The opposite surface of the cathode which will face the anode was provided by plasma jet with a first layer of zirconium oxide and a second layer of antimony pentoxide with a thickness of less than 150$\mu$ for each oxide layer. The zinc layer was then removed by soaking the cathode in a 5% nitric acid solution at 20° C. for 1–2 minutes and washing with distilled water to remove traces of acid. The resulting membrane had a zirconium oxide surface on the cathodic side where it is stable to the alkaline conditions of the anolyte and an antimony pentoxide surface on the anodic side where it is stable to the acid chlorinated conditions of the anolyte. The isoelectric point for the zirconium oxide surface was at least a pH of 5 and for the antimony pentoxide was very low at a pH of less than 2.3. The interface between the two oxide layers is a mixture of the two oxides.

The said ceramic oxide coated electrode was placed in an electrolysis cell to electrolyze a sodium chloride solution of 230–300 g/l of NaCl at 90° C. and a current density of 2000 A/m$^2$. The catholyte flow rate was 0.3 to 0.1 liter/hour with a head of 100 mm ($H_2O$). After 3 days of operation the catholyte composition was NaOH 130 g/l - NaCl 50 g/l and the faraday efficiency was 90%.

EXAMPLE 2

The procedure of Example 1 was repeated except the base material was a titanium anode substrate and the first layer was antimony pentoxide and the second layer was zirconium oxide. The back side of the titanium anode structure was then provided with an electrocatalytic coating of a $RuO_2$-$TiO_2$ mixed crystal material. The anode was then placed in the electrolysis cell and electrolysis was effected as in Example 1.

EXAMPLE 3

The procedure of Example 2 was repeated several times with the zirconium oxide being replaced with $Ta_2O_5$, $TiO_2$ and $Nb_2O_5$. The procedure of Example 2 was also repeated while replacing the antimony pentoxide with $Bi_2O_5$, $MoO_3$, $WO_3$ and $V_2O_5$. The membranes applied on the foraminous anodes all operated safisfactorily in the cell.

Various modifications of the structures and process of the invention may be made without departing from the spirit or scope thereof and it is to be understood that the invention is intended to be limited only as defined in the appended claims.

We claim:

1. A two layer ceramic oxide membrane for electrolysis cells comprising a membrane having on the anodic side a layer of at least one oxide selected from the group consisting of $Sb_2O_5$, $Bi_2O_5$, $MoO_3$, $WO_3$, $V_2O_5$ and mixtures thereof and on the cathodic side a layer of at least one oxide selected from the group consisting of $ZrO_2$, $Nb_2O_5$, $Ta_2O_5$, $TiO_2$ and mixtures thereof.

2. The membrane of claim 1 wherein the membrane is $ZrO_2$-$Sb_2O_5$.

3. The membrane of claim 1 wherein the cathodic side layer is $ZrO_2$.

4. The membrane of claim 1 wherein the anodic side layer is $Sb_2O_5$.

5. The membrane of claim 1 wherein the membrane is not more than 500 $\mu$m thick.

6. An electrode structure comprising an electrically conductive substrate having on the side towards the electrodic gap a two layer ceramic oxide membrane having on the anodic side a layer of at least one oxide selected from the group consisting of $Sb_2O_5$, $Bi_2O_5$, $MoO_3$, $WO_3$, $V_2O_5$ and mixtures thereof and on the cathodic side a layer of at least one oxide selected from the group consisting of $ZrO_2$, $Nb_2O_5$, $Ta_2O_5$, $TiO_2$ and mixtures thereof.

7. The electrode structure of claim 6 wherein the cathodic side layer is $ZrO_2$.

8. The electrode structure of claim 6 wherein the anodic side layer is $Sb_2O_5$.

9. The electrode structure of claim 6 wherein the membrane is $ZrO_2$-$Sb_2O_5$.

10. The electrode structure of claim 6 wherein the substrate is a valve metal provided with an electrocatalytic coating containing a platinum group metal oxide on its active surface.

11. The electrode structure of claim 9 wherein the substrate is titanium.

12. The electrode structure of claim 6 wherein the substrate is a ferrous metal.

13. The electrode structure of claim 12 wherein the membrane is $ZrO_2$-$Sb_2O_5$.

14. In an electrolysis cell comprised of a cell having provided with electrolyte inlet and outlet means, at least one electrode pair of an anode and a cathode, means for impressing a direct current on the cell and means for recovering the electrolysis products, the improvement comprising a two layer ceramic oxide membrane on one of the electrodes with the phase towards the anolyte being selected from the group consisting of $Sb_2O_5$, $Bi_2O_5$, $MoO_3$, $WO_3$, $V_2O_5$ and mixtures thereof and the phase towards catholyte being selected from the group consisting of $ZrO_2$, $Nb_2O_5$, $Ta_2O_5$, $TiO_2$ and mixtures thereof.

15. The cell of claim 14 wherein the cathodic side layer is $ZrO_2$.

16. The cell of claim 14 wherein the anodic side layer is $Sb_2O_5$.

17. The cell of claim 14 wherein the membrane is $ZrO_2$-$Sb_2O_5$.

18. The cell of claim 14 wherein the membrane is on the anode.

19. The cell of claim 14 wherein the membrane is on the cathode.

20. The cell of claim 18 wherein the anode is a valve metal provided with an electrocatalytic coating containing a platinum group metal oxide on its active surface.

21. The cell of claim 19 wherein the cathode is made of a ferrous metal.

22. In an electrolysis process comprising electrolyzing an electrolyte between an anode and a cathode with a direct current, the improvement comprising providing one of the said electrode on its side toward the electrodic gap with a two phase ceramic oxide membrane of claim 1.

23. The process of claim 22 wherein the membrane is on the cathode.

24. The process of claim 22 wherein the membrane is on the anode.

25. The process of claim 22 wherein the cathodic side layer is $ZrO_2$.

26. The process of claim 22 wherein the anodic side layer is $Sb_2O_5$.

27. The process of claim 22 wherein the membrane is $ZrO_2$-$Sb_2O_5$.

28. The process of claim 22 wherein the anode is a valve metal provided with an electrocatalytic coating containing a platinum group metal oxide on its active surface.

* * * * *